US007520760B2

(12) United States Patent
Margulis et al.

(10) Patent No.: US 7,520,760 B2
(45) Date of Patent: Apr. 21, 2009

(54) ELECTRICAL CONNECTOR HAVING BLADE TERMINALS

(75) Inventors: Yan Margulis, Buffalo Grove, IL (US); Arvind Patel, Naperville, IL (US)

(73) Assignee: Molex Incorporated, Lisle, IL (US)

( * ) Notice: Subject to any disclaimer, the term of this patent is extended or adjusted under 35 U.S.C. 154(b) by 0 days.

(21) Appl. No.: 12/033,769

(22) Filed: Feb. 19, 2008

(65) Prior Publication Data

US 2008/0139041 A1 Jun. 12, 2008

Related U.S. Application Data

(63) Continuation of application No. 11/153,772, filed on Jun. 15, 2005, now Pat. No. 7,354,282.

(51) Int. Cl.
*H01R 12/00* (2006.01)

(52) U.S. Cl. ..... 439/79; 439/540.1; 439/660

(58) Field of Classification Search ..... 439/638, 439/246–248, 74–79
See application file for complete search history.

(56) References Cited

U.S. PATENT DOCUMENTS 5,064,391 A 11/1991 Margulis et al.
5,147,228 A * 9/1992 Miller et al. ..... 439/741
5,785,557 A * 7/1998 Davis ..... 439/660
6,319,075 B1 11/2001 Clark et al.
6,422,885 B2 7/2002 Kain et al.
6,491,536 B1 * 12/2002 Torii ..... 439/246
6,802,545 B2 10/2004 Subliskey
6,802,745 B2 10/2004 Loddenkoetter
6,890,221 B2 5/2005 Wagner
6,957,985 B1 * 10/2005 Wang ..... 439/680
7,252,552 B2 * 8/2007 Takimura et al. ..... 439/620.22
7,427,214 B2 * 9/2008 Liao et al. ..... 439/607
2007/0049119 A1 * 3/2007 Fujimoto et al. ..... 439/610

FOREIGN PATENT DOCUMENTS

EP 0537790 B2 7/2000

* cited by examiner

*Primary Examiner*—T C Patel
*Assistant Examiner*—Harshad C Patel
(74) *Attorney, Agent, or Firm*—Stephen L. Sheldon

(57) ABSTRACT

An electrical power blade connector includes a dielectric housing having a mating cavity for receiving a mating connector inserted into the cavity through an open front end thereof in a mating direction. A pair of blade support arms project forwardly within the cavity. The support arms are spaced laterally of the mating direction. Each support arm has a pair of spaced grooves which open toward the other support arm. The grooves extend in the mating direction. A pair of blade terminals are supported in the pairs of grooves in the pair of support arms in spaced, generally parallel planes.

11 Claims, 5 Drawing Sheets

ELECTRICAL CONNECTOR HAVING BLADE TERMINALS

FIELD OF THE INVENTION

This invention generally relates to the art of electrical connectors and, particularly, to an electrical power connector having a plurality of blade terminals.

BACKGROUND OF THE INVENTION

Generally, an electrical connector includes some form of insulative or dielectric housing which mounts one or more conductive terminals. The housing is configured for mating with a complementary mating connector or other connecting device which, itself, has one or more conductive terminals. A connector assembly typically includes a pair of mating connectors, such as plug and receptacle connectors sometimes called male and female connectors. The interengaging terminals of the connectors, themselves, may be male and female terminals.

One type of electrical connector is a power connector which mounts one or more power terminals. With the ever-increasing density of components used in electronic packaging, electrical power connectors often are needed to carry high current between a circuit board and a complementary mating connector or other connecting device, or between a circuit board and a complementary mating connector or other connecting device, or between one circuit board and another circuit board. A typical power connector may be a female or receptacle connector designed to receive a power terminal blade or a bus bar of a power or blade connector. The current is distributed from the blade terminal to various circuit traces on a circuit board, for instance.

Power or blade connectors of the prior art are not designed to carry a variety of voltages and currents in a small low profile connection which can be made inexpensively. The present invention is directed to satisfying these needs and solving the problems of the prior art.

SUMMARY OF THE INVENTION

An object, therefore, of the invention is to provide a new and improved electrical power blade connector of the character described and which has a plurality of blade terminals.

In the exemplary embodiment of the invention, the connector includes a dielectric housing having a mating cavity for receiving a mating connector inserted into the cavity through an open front end thereof in a mating direction. A pair of blade support arms project forwardly within the cavity. The support arms are spaced laterally of the mating direction. Each support arm has a pair of spaced grooves which open toward the other support arm. The grooves extend in the mating direction. A pair of blade terminals are supported in the pairs of grooves in the pair of support arms in spaced, generally parallel planes.

The invention contemplates that a dielectric separation wall spans the pair of blade support arms between the pair of blade terminals. In the preferred embodiment, the separation wall is integral with the blade support arms.

As disclosed herein, the cavity is formed by peripheral walls of the housing. The peripheral walls surround and are spaced from the blade support arms, the separation wall and the blade terminals.

Other objects, features and advantages of the invention will be apparent from the following detailed description taken in connection with the accompanying drawings.

BRIEF DESCRIPTION OF THE DRAWINGS

The features of this invention which are believed to be novel are set forth with particularity in the appended claims. The invention, together with its objects and the advantages thereof, may be best understood by reference to the following description taken in conjunction with the accompanying drawings, in which like reference numerals identify like elements in the FIGS. and in which:

DETAILED DESCRIPTION OF THE PREFERRED EMBODIMENT

Figure 1:
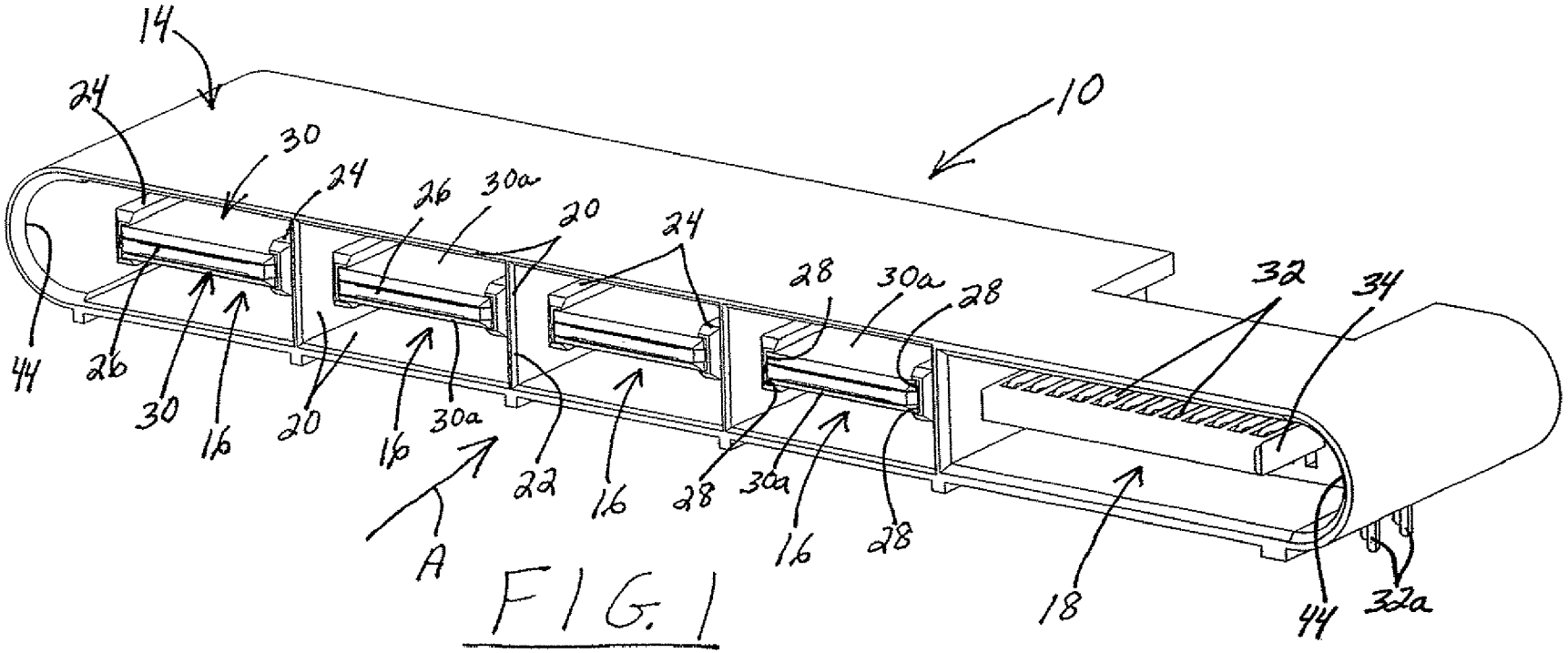
FIG. 1 is a perspective view of an electrical power blade connector embodying the concepts of the invention, looking at the mating face of the connector.
Figure 2:
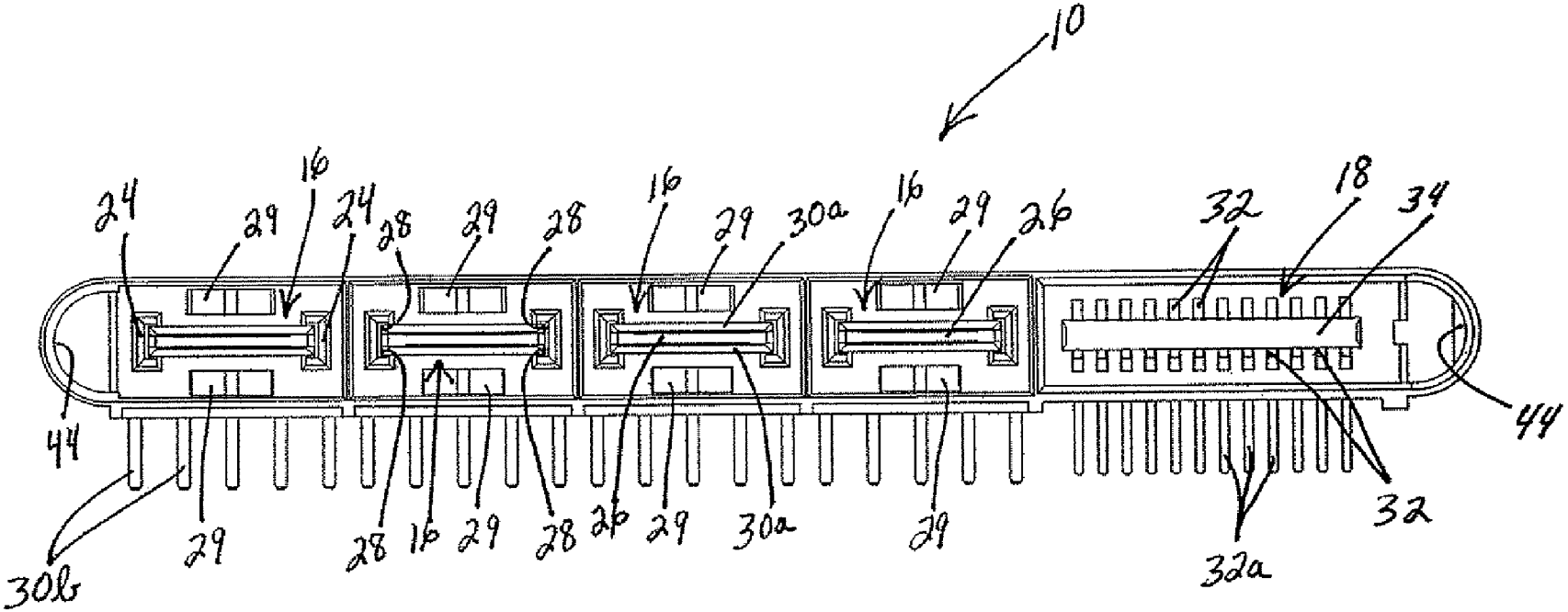
FIG. 2 is a front elevational view of the blade connector.
Figure 3:
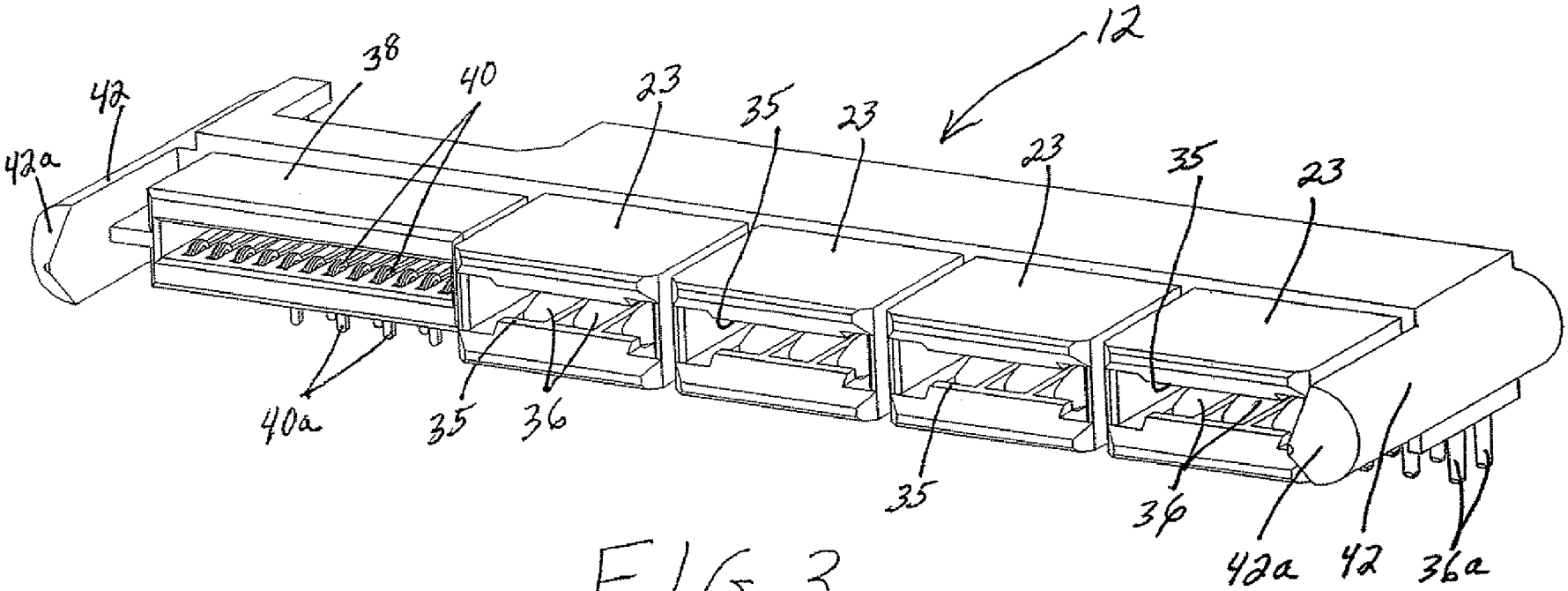
FIG. 3 is a perspective view similar to that of FIG. 1, but of a receptacle connector for mating with the blade connector of FIGS. 1 and 2.
Figure 4:
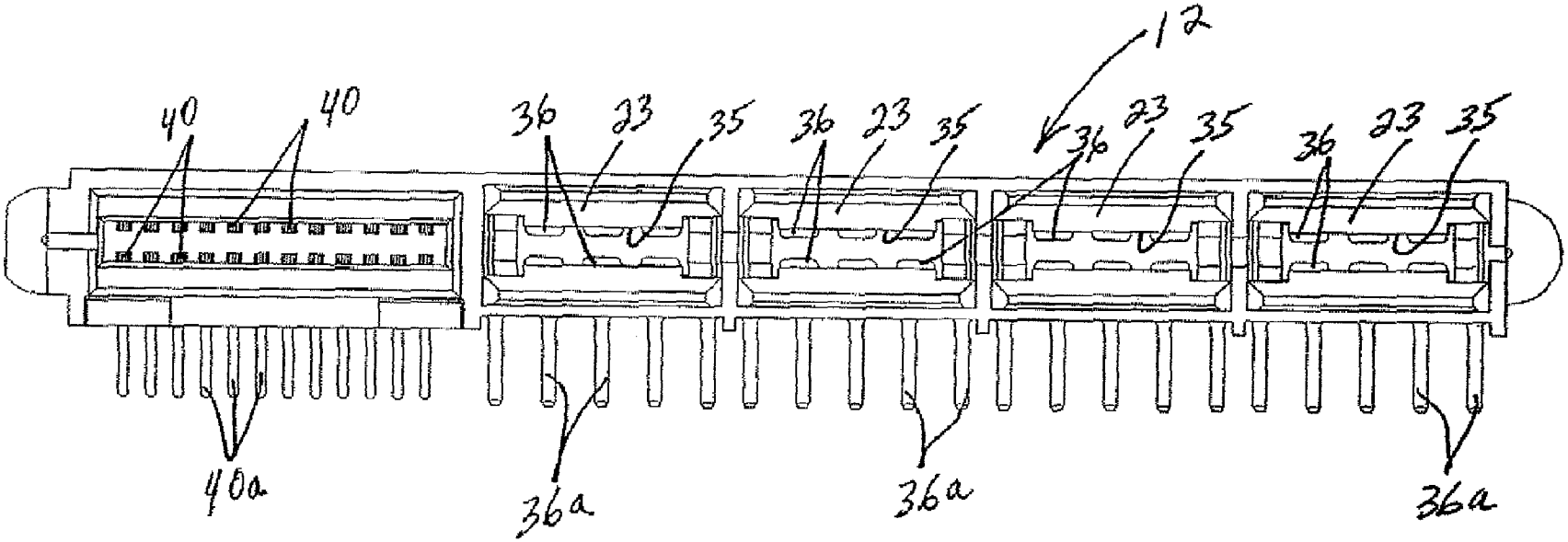
FIG. 4 is a front elevational view of the receptacle connector of FIG. 3.
Figure 5:
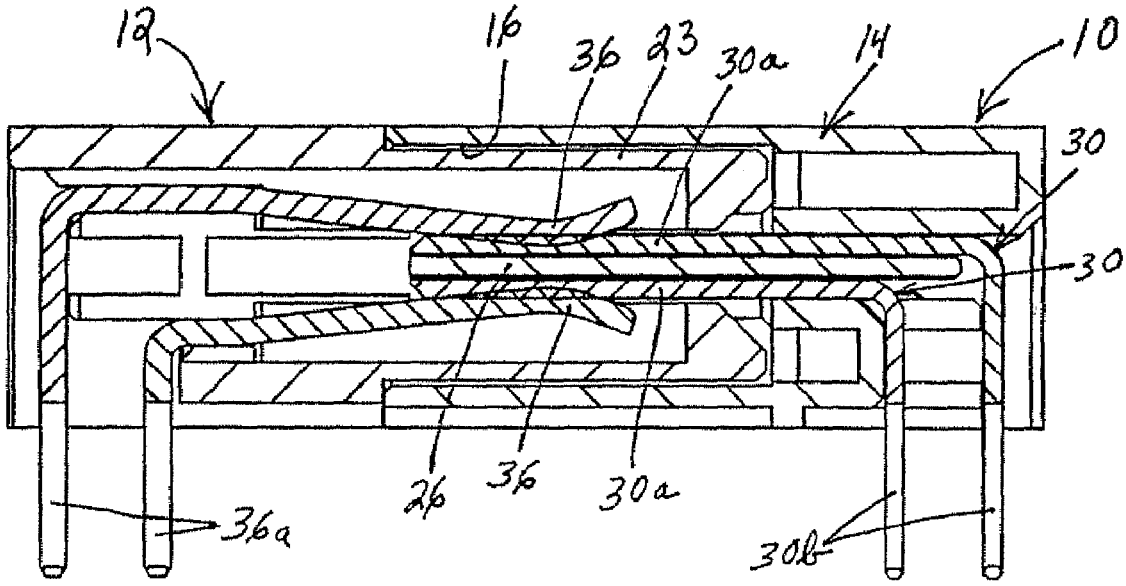
FIG. 5 is an enlarged front-to-rear section through the blade and receptacle connectors in mated condition.

Referring to the drawings in greater detail, FIGS. 1 and 2 show a blade connector, generally designated 10, embodying the concepts of the invention and which is mateable with a receptacle connector, generally designated 12 in FIGS. 3 and 4, FIG. 5 shows a sectional depiction of blade connector 10 mated with receptacle connector 12.

Referring to FIGS. 1 and 2, blade connector 10 includes a dielectric housing, generally designated 14, which forms four mating cavities, generally designated 16, along with a fifth cavity, generally designated 18. At this point, it should be understood that connector 10 is a "composite" connector in that each of the mating cavities 16/18 could as well be the mating cavities of five different or independent connectors in the context of the invention herein. The composite configuration of connector 10 saves space by embodying five distinct mating cavities in a single housing 14 for receiving five mating portions of receptacle connector 12 which also is a composite connector. With those understandings, much of the following specification will describe a single one of the mating cavities 16, it being understood that all of the other mating cavities 16 and the interior components thereof are substantially identical.

Each mating cavity 16 is generally rectangular and is formed by four peripheral walls 20 of housing 14. Each cavity has an open front end 22 into which a mating plug portion 23 of receptacle connector 12 is inserted in a mating direction "A" (FIG. 1).

The invention contemplates the provision of a pair of blade support arms 24 which project forwardly within each mating cavity 16 opposite mating direction "A". The support arms are spaced laterally of the mating direction. A dielectric separation wall 26 spans the pair of blade support arms. The separation wall and the support arms form a pair of spaced grooves 28 in each support arm, with the grooves in each arm opening toward the other arm. The grooves extend in mating direction "A". Peripheral walls 20 of housing 14 surround and are spaced from blade support arms 24 and separation wall 26. A plurality of core holes 29 are located at the bases of cavities 16, for molding purposes and to prevent mold sink at the thickest areas of the housing.

Blade connector 10 includes a pair of blade terminals, generally designated 30, for each mating cavity 16. Each blade terminal 30 includes a planar blade portion 30*a* (FIG. 1)

and a plurality of tail portions 30*b* (FIG. 2). The tail portions are provided for insertion into appropriate holes in a first printed circuit board (not shown) and for connection to appropriate circuit traces on the board and/or in the holes. The planar blade portions 30*a* of each pair of blade terminals 30 project forwardly within a respective one of the mating cavities 16 in spaced, generally parallel planes. Specifically, blade portions 30*a* of each pair of blade terminals 30 are separated by separation wall 26 which spans the respective pair of blade support arms 24, with opposite edges of the blade portions being disposed within grooves 28 in the inside faces of the blade support arms. Separation wall 26 isolates the pair of blade portions 30*a* and prevent arcing therebetween.

The fifth mating cavity 18 of the composite blade connector 10 simply forms a signal connector and does not form part of the invention herein. The signal connector includes a plurality of signal terminals 32 mounted on opposite sides of a plug 34 projecting forwardly within mating cavity 18. The signal terminals have tail portions 32*a* for insertion into appropriate holes in the first printed circuit board and for connection to appropriate signal circuit traces on the board and/or in the holes.

Referring to FIGS. 3 and 4, each mating plug portion 23 of receptacle connector 12 includes an H-shaped receptacle 35 for receiving the combined structure of the pair of blade support arms 24, blade portions 30*a* and separation wall 26 within each mating cavity 16 of blade connector 10. A plurality of terminals 36 are disposed within each receptacle 35, at the top and bottom of the receptacle, for engaging the blade portions 30*a* at the top and bottom of separation wall 26 of a pair of the blade terminals 30 of blade connector 10. Terminals 36 have tail portions 36*a* for insertion into appropriate holes in a second printed circuit board and for connection to appropriate circuit traces on the board and/or in the hole.

Receptacle connector 12 includes a fifth mating plug portion 38 mounting a plurality of signal terminals 40 therewithin. Mating plug portion 38 is inserted into the fifth mating cavity 18 of blade connector 10 when the connectors are mated. Terminals 40 of the receptacle connector engage terminals 32 of the blade connector. Terminals 40 of the receptacle connector have tails portions 40*a* for insertion into appropriate holes in the second printed circuit board and for connection to appropriate signal circuit traces on the board and/or in the holes. Finally, receptacle connector 12 includes a pair of semi-cylindrical guide posts 42 at opposite ends of the receptacle connector for insertion into a pair of semi-cylindrical guide sockets 44 at opposite ends of housing 14 of blade connector 10 to guide the two connectors into mated condition. The distal ends of guide posts 42 are chamfered, as at 42*a*, to guide the posts into sockets 44.

FIG. 5 shows blade connector 10 in mated condition with receptacle connector 12, and illustrating a front-to-rear sectional depiction through one of the mating cavities 16 of the blade connector and one of the mating plug portions 23 of the receptacle connector. It can be seen that the top and bottom terminals 36 of the receptacle connector form a mouth therebetween and into which the pair of blade portions 30*a* of blade terminals 30 are inserted, with separation wall 26 separating and isolating the blade portions of the blade terminals. Separation wall 26 could be a separate component adhered between blade portions 30*a* of the pair of blade terminals 30. However, it is contemplated that separation wall 26 be made integral with housing 14, integrally between support arms 24, in a unitary structure.

From the foregoing, it can be seen that blade connector 10, along with receptacle connector 12, are quite small low profile connectors that can be fabricated quite inexpensively. Nevertheless, the pair of isolated blade terminals 30 within each mating cavity 16 can carry a variety of voltages and currents.

It will be understood that the invention may be embodied in other specific forms without departing from the spirit or central characteristics thereof. The present examples and embodiments, therefore, are to be considered in all respects as illustrative and not restrictive, and the invention is not to be limited to the details given herein.

The invention claimed is:

1. An electrical power blade connector, comprising:

a dielectric housing having a mating cavity for receiving a mating connector inserted into the cavity through an open front end thereof in a mating direction, the mating cavity defined by four peripheral walls;

a pair of blade support arms projecting forwardly within the cavity, the pair of blade support arms being spaced laterally of the mating direction;

a pair of blade terminals supported between the pair of blade support arms, each blade terminal of the pair of blade terminals separated from the other blade terminal of the pair of blade terminals by a dielectric wall, wherein the pair of blade terminals is isolated from other terminals by the four peripheral walls.

2. The electrical power blade connector of claim 1 wherein the peripheral walls of the housing are spaced from the blade support arms, the dielectric wall and the blade terminals.

3. The electrical power blade connector of claim 1, wherein the dielectric wall is integral with the blade support arms.

4. The electrical power blade connector of claim 1, wherein the cavity is a first cavity and the pair of blade terminals is a first pair of blade terminals, the connector further comprising a second cavity, the second cavity including a second pair of blade terminals, the second pair of blade terminals isolated from the first pair of blade terminals by at least one peripheral wall.

5. The electrical power blade connector of claim 1, wherein each blade terminal of the pair of blade terminals is supported on four sides.

6. A connector, comprising:

a housing, the housing including a first mating cavity defined by four walls, the first mating cavity having an open end facing a mating direction;

an I-beam shaped first support structure positioned in the first mating cavity and extending toward the open end; and a first and a second blade terminal positioned in the cavity in a substantially parallel configuration, each of the first and second blade terminal restrained by the first support structure on four sides.

7. The connector of claim 6, wherein the first support structure forms two channels, each channel having a "C" shaped side that restrains one of the first and second blade terminals on three sides.

8. The connector of claim 6, wherein the connector further comprises a second mating cavity defined by four walls and an open end, the connector further including an I-beam shaped second support structure positioned in the second mating cavity that extends toward the open end and the connector further including a pair of blade terminals supported by the second support structure.

9. The connector of claim 8, wherein one of the four walls that forms the first mating cavity isolates the first mating cavity from the second mating cavity.

10. The connector of claim 9, wherein the wall that isolates the first mating cavity from the second mating cavity is one of four walls that defines the second mating cavity.

11. A connector, comprising:

a housing, the housing including a plurality of mating cavities, each of the plurality of cavities defined by four walls and having an open end facing a mating direction;

a plurality of I-beam shaped support structures, wherein one I-beam shaped structure is positioned in each of the plurality of mating cavities and the I-beam shaped structure extends toward the open end; and a pair of blade terminals positioned in each of the plurality of cavities in a substantially parallel configuration, each pair of blade terminals supported by a different one of the plurality of I-beam shaped support structures.

* * * * *